US011262036B1

(12) United States Patent
Hein et al.

(10) Patent No.: US 11,262,036 B1
(45) Date of Patent: Mar. 1, 2022

(54) HIGH MAST LIGHTING SYSTEM

(71) Applicant: NLS LIGHTING, LLC, Carson, CA (US)

(72) Inventors: William A. Hein, Manhattan Beach, CA (US); Cory Landefeld, Long Beach, CA (US); Katsuhiro Unoki, Lomita, CA (US); Erik Van Wier, Rancho Palos Verdes, CA (US); Ryan Goldstein, Los Angeles, CA (US); Ashraf Alfayez, Long Beach, CA (US); Frank Mata, La Mirada, CA (US); Hermonio Montoya, Downey, CA (US); Jeremiah Van Wier, Redondo Beach, CA (US)

(73) Assignee: NLS Lighting, LLC, Carson, CA (US)

( * ) Notice: Subject to any disclaimer, the term of this patent is extended or adjusted under 35 U.S.C. 154(b) by 0 days.

(21) Appl. No.: 16/923,923

(22) Filed: Jul. 8, 2020

(51) Int. Cl.

| | |
|---|---|
| ***F21S 8/08*** | (2006.01) |
| ***H05B 47/19*** | (2020.01) |
| ***H05B 45/30*** | (2020.01) |
| *F21W 131/105* | (2006.01) |
| *F21Y 115/10* | (2016.01) |

(52) U.S. Cl.
CPC ..... *F21S 8/086* (2013.01); *H05B 45/30* (2020.01); *H05B 47/19* (2020.01); *F21W 2131/105* (2013.01); *F21Y 2115/10* (2016.08)

(58) Field of Classification Search
CPC ..... F21S 8/086; H05B 47/19; H05B 45/30; F21Y 2115/10; F21W 2131/105; F21V 21/14; F21V 21/26; F21V 21/30
See application file for complete search history.

(56) References Cited

U.S. PATENT DOCUMENTS

| | | | | |
|---|---|---|---|---|
| 4,190,881 | A * | 2/1980 | Drost | F21V 21/116 362/238 |
| 5,975,726 | A * | 11/1999 | Latimer | F21V 21/38 362/249.07 |
| 7,828,463 | B1 * | 11/2010 | Willis | F21V 23/0442 362/276 |
| 10,337,693 | B1 * | 7/2019 | Gordin | F21V 29/76 |
| 10,344,948 | B1 * | 7/2019 | Gordin | H05B 47/19 |
| 2006/0186348 | A1 * | 8/2006 | Nguyen | G07D 7/1205 250/484.4 |
| 2006/0187663 | A1 | 8/2006 | Gordin | |
| 2009/0135411 | A1 * | 5/2009 | Gordin | 356/138 |
| 2012/0075859 | A1 * | 3/2012 | Granado | F21V 29/60 362/249.02 |

* cited by examiner

*Primary Examiner* — Bao Q Truong
(74) *Attorney, Agent, or Firm* — Advantage IP Law Firm

(57) ABSTRACT

This disclosure describes, among other things, embodiments of high mast lighting systems with at least one crossarm for mounting at a location along a height of a light pole disposed about a venue, the crossarm including one or more luminaires with the luminaires having associated LED drivers that may be controlled by one or more control nodes disposed locally on or at the pole, within an enclosure or housing, or nearby.

30 Claims, 15 Drawing Sheets

HIGH MAST LIGHTING SYSTEM

BACKGROUND

1. Field of the Disclosure

The present disclosure relates to lighting systems, and more specifically, to high mast lighting systems used to illuminate one or more areas in either outdoor or indoor settings, especially areas like those used for sporting and recreational events as well as a host of other applications including parks, ports, freeways, and other indoor or outdoor high mast lighting applications.

2. Background Art

Lighting systems are typically required for illuminating outdoor settings such as sports fields, tennis courts, outdoor basketball courts, concert venues, ports, and other outdoor and indoor venues. These lighting systems commonly locate one or more fixtures on one or more light poles surrounding the venue at a height typically ranging from 40 to 200 feet in the air placing the fixtures generally well out of reach for both installation and maintenance unless a suitable lift or crane having an attached maintenance basket is used. Depending on the intended use and setting data, the desired lighting characteristics drive the choice of lighting element, installation height, housing shape, number of lighting elements, and angle of mounting. These choices are often driven by the need to achieve the light level recommendations of the IES (Illuminating Engineer Society) for a given lighting application.

In more recent times, and in the outdoor lighting marketplace in particular, light emitting diode (LED) solid state lighting systems have become the preferred lighting element given that the benefits of low wattage usage, longevity, light quality, and lower heat generation, among other factors, generally outweigh the costs of exchanging conventional light sources such as high intensity discharge (HID) lighting. Initially, the retrofitting efforts focused on low wattage parking structure, wall packs, surface mounted, and pedestrian scale decorative fixtures and streetlights. The next phase in the retrofitting process involved mid-wattage applications such as parking lot and flood lighting applications. More recently, however, the retrofitting market has set its sights on high wattage sports lighting and high mast fixtures for ports, freeways, and outdoor sporting and recreational venues.

Initially, the marketplace focused primarily on replacing individual fixtures based on lumens and the electrical interface between the upgraded lighting element and a control cabinet. For example, U.S. Pat. No. 10,337,693 to Gordin offered one solution for retrofitting an existing HID (high intensity discharge) lamp fixture with LED lighting fixtures mounted atop a pole on a one to one basis, especially in a sports field or wide area lighting arena. In the '693 Gordin patent, delivery of power to HID fixtures along power lines is regulated and/or controlled at multiple points in the circuit as, for example, at a pole cabinet on pole, at a control/contactor cabinet, and at a distribution cabinet. Power wiring is typically internally routed through the light pole, into a crossarm, through an adjustable armature, and to each HID fixture in an array of fixtures. However, in the context of retrofitting the sports lighting system of HID fixtures to LED fixtures, this translates to some sort of change to power regulating means at the pole cabinet. While power is distributed at service distribution cabinet and controlled (e.g., turned on and off in accordance with a preset schedule) at a control/contactor cabinet, power is ultimately conditioned and regulated for the particular load (i.e., one or more HID sources) at a pole cabinet via a ballast tied to a modified capacitor bank. The HID light fixture is replaced with a new LED lighting fixture. Finally, a rectifier control circuit is added between the LED fixture and the ballast and new capacitor bank as part of the retrofit solution. The rectifier control circuit is introduced into the overall circuit so to condition power downstream of the ballast and new capacitors for the LED load. This approach attempts to alleviate the additional cost of replacing the ballasts.

In U.S. Pat. No. 10,344,948, also to Gordin and a continuation of the '693 Gordin patent, the ballast is replaced with a set of drivers in communication with the LED fixtures and a gateway device that is further in communication with a third party control system. Of interest in both the '693 and '948 Gordin patents, the on pole mounted cabinet only includes the ballast/capacitor bank/rectifier control circuit or drivers/gateway device along with a set of relay switches and circuit breakers. In both patents, the control module is located in a control/contactor cabinet located off pole and in a remote location such as a control center. It is apparent that these Gordin patents do not address servicing the controls directly on or proximate the light pole at a convenient maintenance location. As such, the Gordin patents also do not address customizing the controls within or at a pole cabinet as the features of the lighting poles and associated fixtures change. Finally, the Gordin patents include a pole topper retrofit assembly wherein the crossarm is mounted to a pole sleeve with a cap that telescopically fits over an existing light pole. This restricts the ability to locate the crossarms at different heights along the light pole or adjust the crossarms once mounted.

In general, prior technical solutions incorporating on pole cabinets may include LED drivers but lack the controls so they cannot control individual lighting elements. Instead, they typically control lighting circuits from relays mounted next to circuit breakers, which control fixture groups, not individual fixtures in a group of fixtures. In such case, the resulting fixture control is an all or nothing approach with all the fixtures in a group being controlled on or off instead of an individual fixture. This significantly reduces the extent of overall control of the lighting system. Moreover, as discussed above, the controls for such lighting systems are typically located off pole in a location such as a recreation control room, often offsite or located remotely from the light poles and cabinets themselves. Such recreation control room controls are often secured and run by a third party, such as a city maintenance crew or may be proprietary requiring access and cooperation of a third party to maintain, upgrade, or exchange. As the controls are not present at the light poles themselves, they cannot be exchanged or upgraded right at the light pole as new features and capabilities are added to the light pole system.

Given the drawbacks of the current technological approaches to controlling individual fixtures and installing lighting systems, there exists a need for an improved high mast lighting system that facilitates local on or near the pole control of individual fixtures in a convenient easy to access location while establishing an enclosure configuration allowing for exchange, customization, and upgradeability of control components along with a modular installation system capable of accommodating both new and retrofitting assemblies.

SUMMARY

Exemplary embodiments described herein have innovative features, no single one of which is indispensable or solely responsible for their desirable attributes. Without limiting the scope of the claims, some of the advantageous features will now be summarized.

In some embodiments, a high mast lighting system is disclosed with at least one elongated upright pole having a lower end section and a crossarm mounting section including a mid-point of the pole and at least one crossarm coupled to the pole within the crossarm mounting section with at least one luminaire coupled to the crossarm, the luminaire having at least one LED array responsive to a power supply to emit light from the luminaire with at least one local control node disposed below the mid-point of the light pole and at least one programmable LED driver responsive to monitoring and control communications from the local control node.

In other embodiments, the high mast lighting system further comprises a housing mounted on or near the pole below the mid-point and at a distal location from the crossarm, the housing enclosing the LED drivers and at least one control node and wherein a power supply line entering the housing is placed in communication with the LED drivers and control node.

In some embodiments, the crossarm s pre-aimed in both tilt and rotational directions prior to mounting on the pole based on a venue photometric analysis.

In yet other embodiments, the control node is a network device in communication with a network and may send, receive, and forward information about the LED drivers and/or the LED arrays. The control node may also be used to control the LED drivers and may program the LED drivers to turn the associated LED array on or off as well as flash and/or dim individual luminaires.

In certain other embodiments, a laser aiming subsystem is attached to the light pole and may be aimed at a target to align the crossarm in either the X or Y axis alignment directions.

Other embodiments of the high mast lighting system incorporate multiple crossarms, each with their own set of luminaires in communication with an associated enclosure.

Still other embodiments locate the control node on or near the light pole well beneath the mid-point of the light pole and easily accessible without a lift.

Methods of installing a high mast lighting system are also disclosed herein.

BRIEF DESCRIPTION OF THE DRAWINGS

The following drawings and the associated descriptions are provided to illustrate embodiments of the present disclosure and do not limit the scope of the claims.

DETAILED DESCRIPTION

Figure 1:
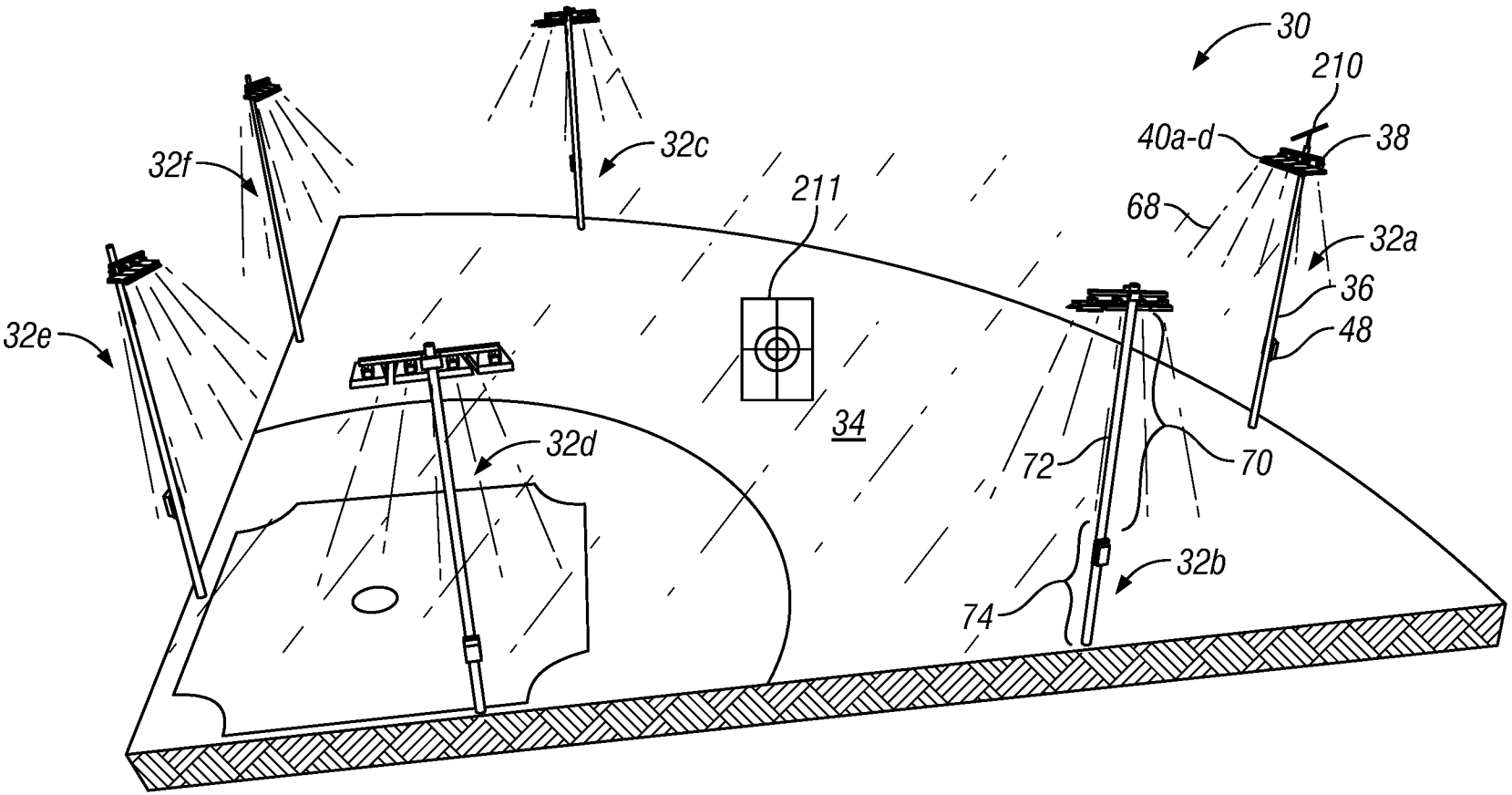
FIG. 1 is a perspective view of an exemplary embodiment of a high mast lighting system, used in an exemplary outdoor sports field or court setting such as the depicted baseball field.
Figure 2:
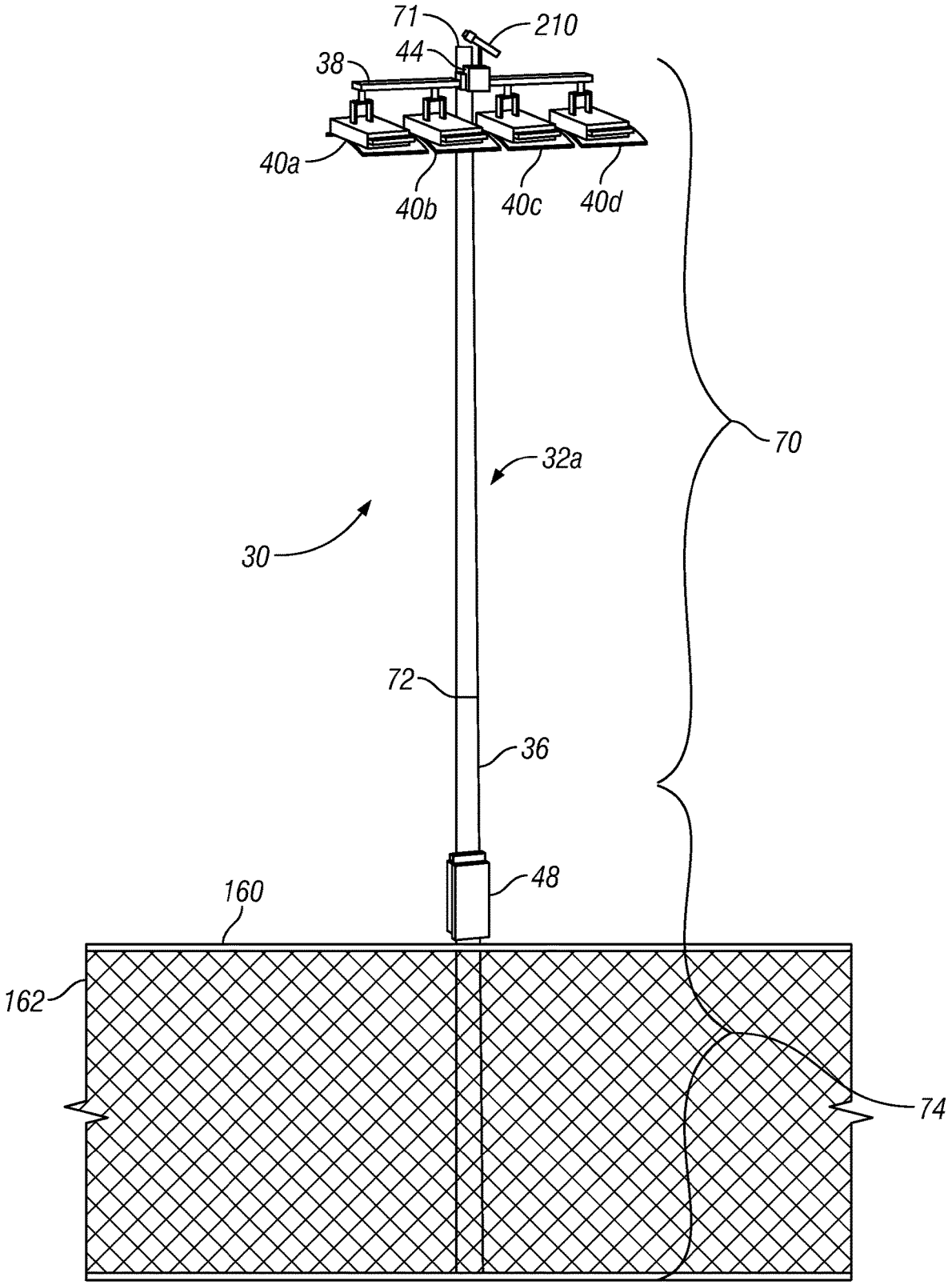
FIG. 2 is a perspective view of an exemplary single crossarm, four luminaire configuration on a single lighting pole with a local housing disposed at an easily accessible height proximate the uppermost fence line as taken from FIG. 1, in enlarged scale.

Referring initially to FIGS. 1-2, in general terms an exemplary embodiment of a high mast lighting system, generally designated 30, is provided with one or more light pole assemblies, generally designated 32*a-f*, strategically positioned at one or more locations around a venue 34 such as a sports field, park, court, pool, event field, port, parking structure, theme park, with each light pole assembly including a light pole 36, at least one crossarm 38, and at least one luminaire set 40*a-d* per crossarm. In this initial embodiment, a single crossarm supporting four luminaires is depicted, although this is not meant to be limiting. Placement, tilt, rotation, and height of the light poles, crossarms, and luminaires are typically determined by a photometric analysis of the venue or site. As the light pole assemblies are constructed in a similar fashion, a single light pole assembly 32*a* will be described.

Figure 3:
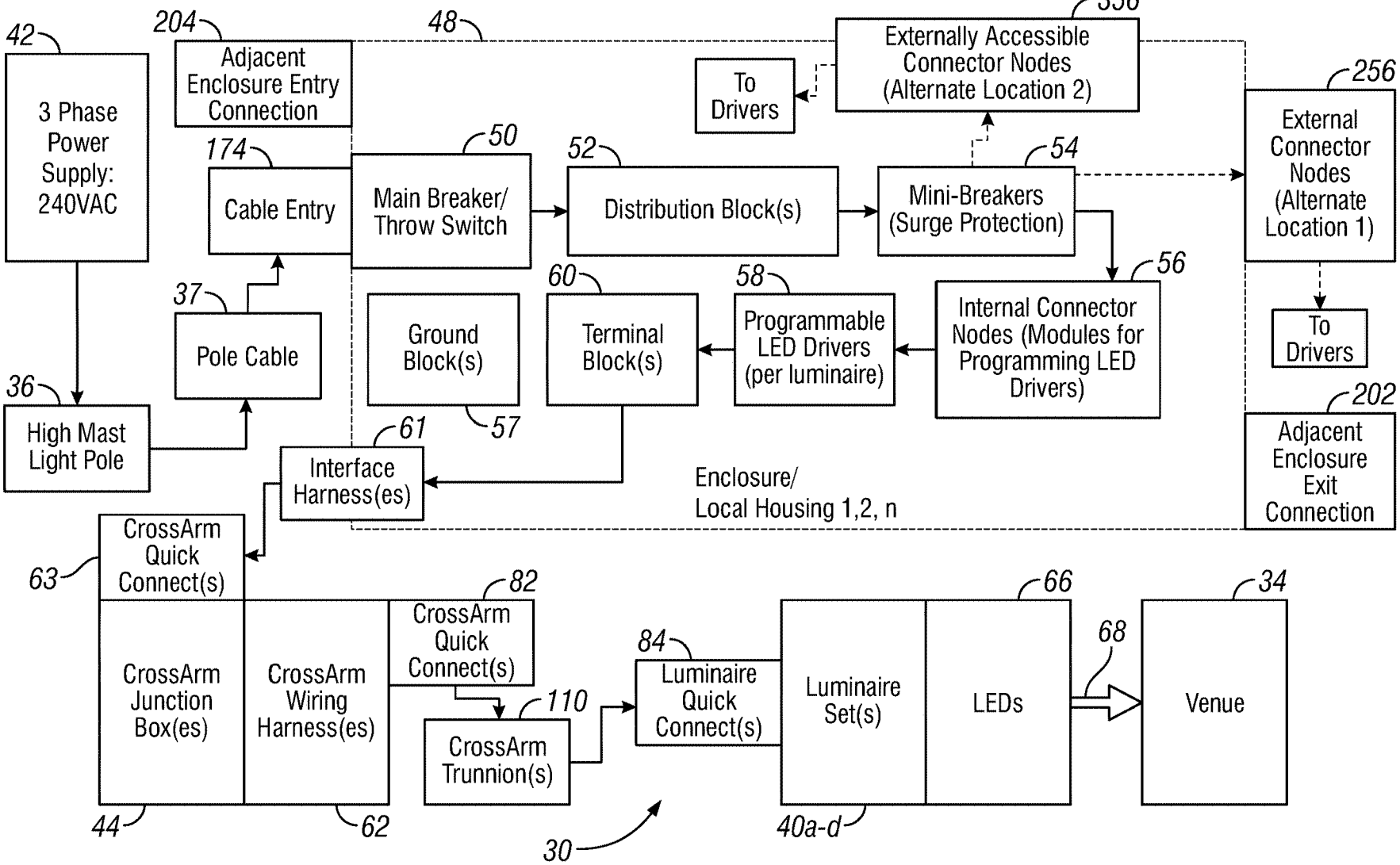
FIG. 3 is a schematic view of an exemplary embodiment of a high mast lighting system.

In one embodiment of the high mast lighting system 30 as shown in a schematic block of FIG. 3, a three phase 240 VAC power supply line 42 provided by a local power source at or near the venue 34 enters or feeds into the light pole assembly 32*a* (FIGS. 1-2) via an opening 39 (FIG. 15) in the bottom of the light pole leading to a hollow interior 76 (FIGS. 4 and 15) of the light pole 36 of the light pole assembly 32*a* (FIG. 1). Alternative entry locations may be used as well such as drilling a hole in the exterior of the light pole above ground leading to the interior. Likewise, the top end of the light pole 36 may have at least one pole cable aperture for passing the pole cable through to meet a subsequent connection or a connection between the pole cable and the crossarm wiring harness may take place inside the crossarm or inside the pole. The power supply line 42 transitions into a pole cable 37 (FIGS. 3, 11, and 18) which enters a cable entry opening 174 (FIGS. 3, 12, and 13) of an enclosure or local housing 48 (if used). Once inside the enclosure 48, the pole cable 37 is connected to a main breaker subsystem 50 with a throw or kill switch 182 (FIG. 13). From the main breaker, the electrical path continues to at least one 600V distribution block 52 (FIGS. 3 and 12), depicted as 52*a-c* in FIG. 14. A set of mini-breakers 54 (depicted as 54*a-b* in FIGS. 12-13 and as 54-*c* in FIG. 14), preferably 20 amp surge protectors, may be interposed between the distribution block and a set of one or more connector (or control) nodes 56, typically in the amount of one control node 56 per luminaire 40*a-d* such as that depicted by nodes 56*a-d* in FIGS. 12-13. The electrical path then continues from the control nodes 56 to a set of one or more programmable LED drivers 58, one for each control node, such as LED drivers 58*a-d* in FIG. 12. The electrical path then continues on into one or more terminal blocks 60, which are in turn connected to drop cables (e.g., 15 pin, 14GA) or interface harnesses 61, depicted as 61*a-d* in FIG. 17) leading to a terminal block or quick connect 63 of one end of a crossarm wiring harness 62 in a junction box 44 at the crossarm 38. One or more ground blocks 57 may be used to tie the electrical components into a grounded connection.

Still referring primarily to FIG. 3, after the interface harnesses 61 are connected to the crossarm wiring harness 62 within the crossarm junction box 44 by the quick connect 63, the other end of the wiring harness 62 splits into a number of sub-harnesses, one for each luminaire 40*a-d* and including a second quick connect 82 (FIGS. 3 and 9) which is connected to another quick connect 84 (FIGS. 3, 7 and 9) within a trunnion 110 coupled to a set of one or more LED luminaires 40*a-d* with each luminaire including at least one LED array 66, the ultimate load of the electrical path, which when supplied with power may illuminate one more sections of a venue 34 with light rays 68. It will be appreciated that throughout this description, one or more terminal blocks, such as those depicted at 146 in FIG. 17 within the junction box 44, may be used instead of quick connects and are generally used interchangeably throughout this description. Further details about each component will now be described.

Referring back to FIGS. 1-2, the light pole 36 of the light pole assembly 32*a* is a single or multi-piece elongated tubular extension constructed to position at least one crossarm 38 and associated luminaire set 40*a-d* at a height preferably between forty to two hundred feet in the air. The light pole includes an upper end 70 defining a crossarm mounting section with a top end 71 (FIG. 4), which is preferably closed off to seal the interior from the elements, and further including a mid-point 72 along the height of the pole. A complementary lower end enclosure mounting section 74 is also included as a portion of the pole 36. The pole 36 includes a hollow interior 76 (FIGS. 4 and 15) for receiving an electrical conduit 37 (or wiring harness or pole cable) for transmitting power from a built-in or remote power source supply line 42 (FIG. 3) as would be understood by one of ordinary skill in the art. The lower end 74 of the light pole includes a flange 78 (FIG. 15) with bolt holes for anchoring the light pole to an underlying support surface such as a concrete footing or slab. Other suitable methods for installing or securing a light pole to an underlying support surface about the venue and feeding a power supply line into the pole are well known. It will be appreciated that the high mast lighting system 30 may be used to retrofit an existing pole set or installed along with new pole installations. The light pole 36 further provides a variety of height adjustable locations on which to secure one or more crossarms 38 as explained further below.

Referring now to FIGS. 1-2, 4, and 7-9, the crossarm 38 is an elongated tubular structure generally constructed to be mounted at a right or substantially right angle to the light pole. In this exemplary embodiment, the crossarm is preferably pre-wired with a wiring harness 62 that terminates at one end in a first quick connect coupling 82 (FIGS. 3, 7, 9) for coupling to a quick disconnect end 84 of the luminaire set 40*a-d* (FIGS. 3, 7, 9) and a second quick connect coupling 63 (FIGS. 3 and 17) for connecting to an interface harness 61 (FIG. 3) for each enclosure 48*a-n*.

Figure 4:
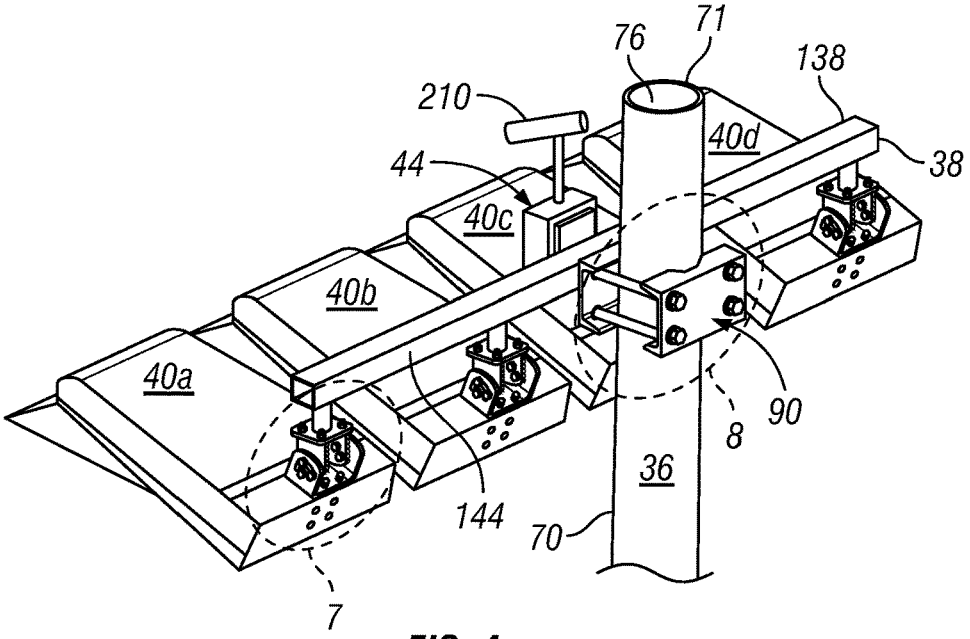
FIG. 4 is a broken perspective view of an exemplary crossarm and luminaire assembly coupled to the upper section of a light pole in enlarged scale.
Figure 5:
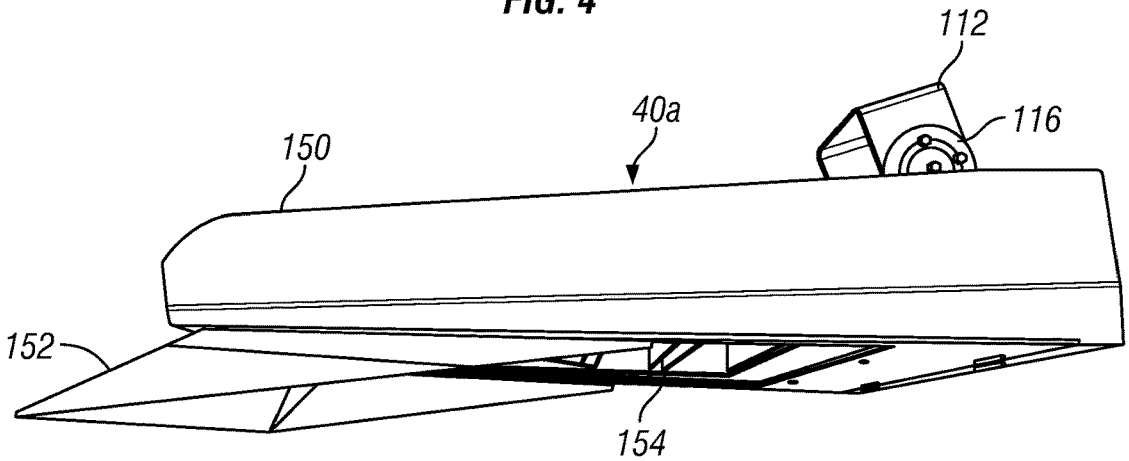
FIG. 5 is a side view of an exemplary luminaire, in enlarged scale, that may be used with a high mast lighting system.
Figure 6:
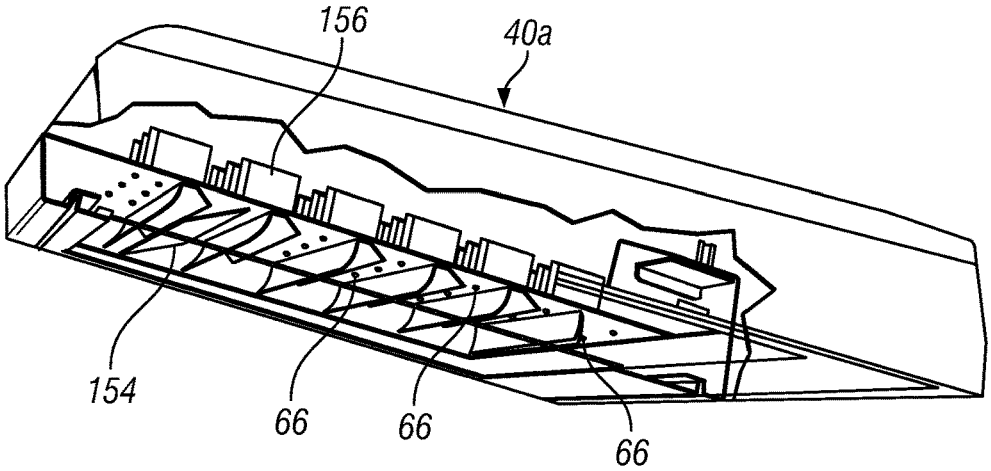
FIG. 6 is a side partial cutaway view of the exemplary luminaire of FIG. 5 with the glare shield and trunnion removed.
Figure 8:
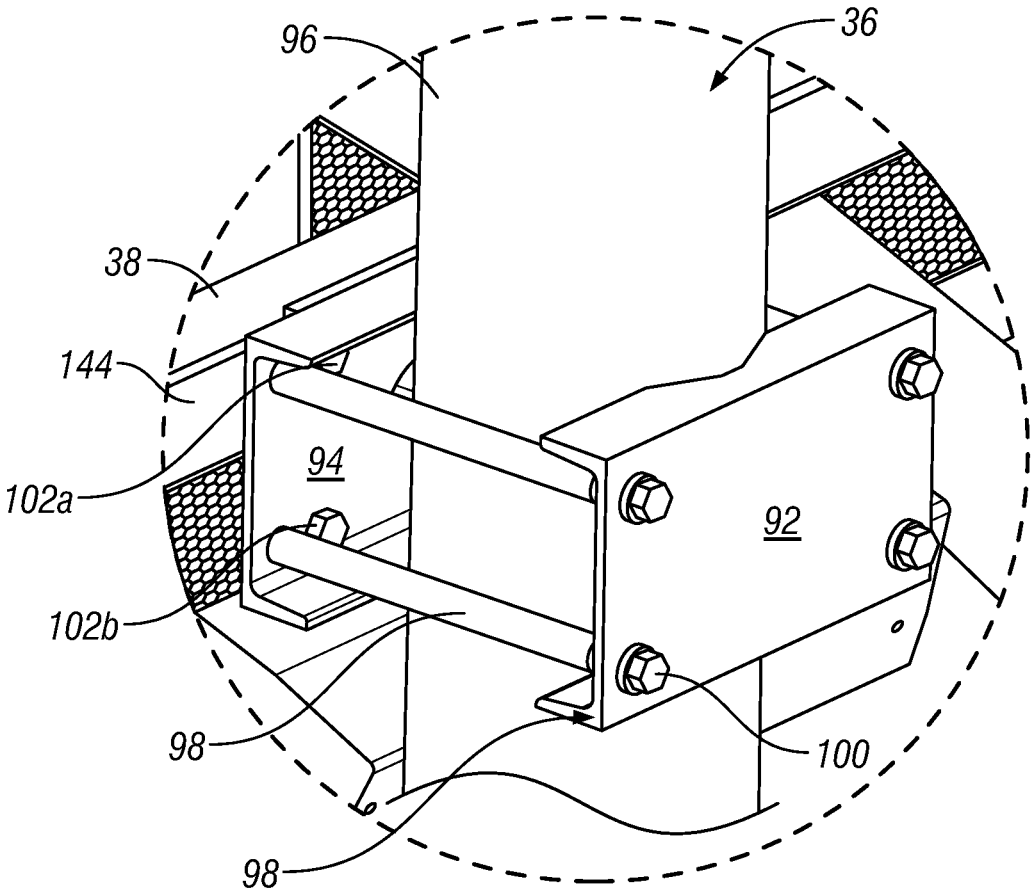
FIG. 8 is a perspective view of an exemplary clamping assembly, in enlarged scale, that may be used to couple a crossarm to a light pole as taken from the circle 8 of FIG. 4.
Figure 9:
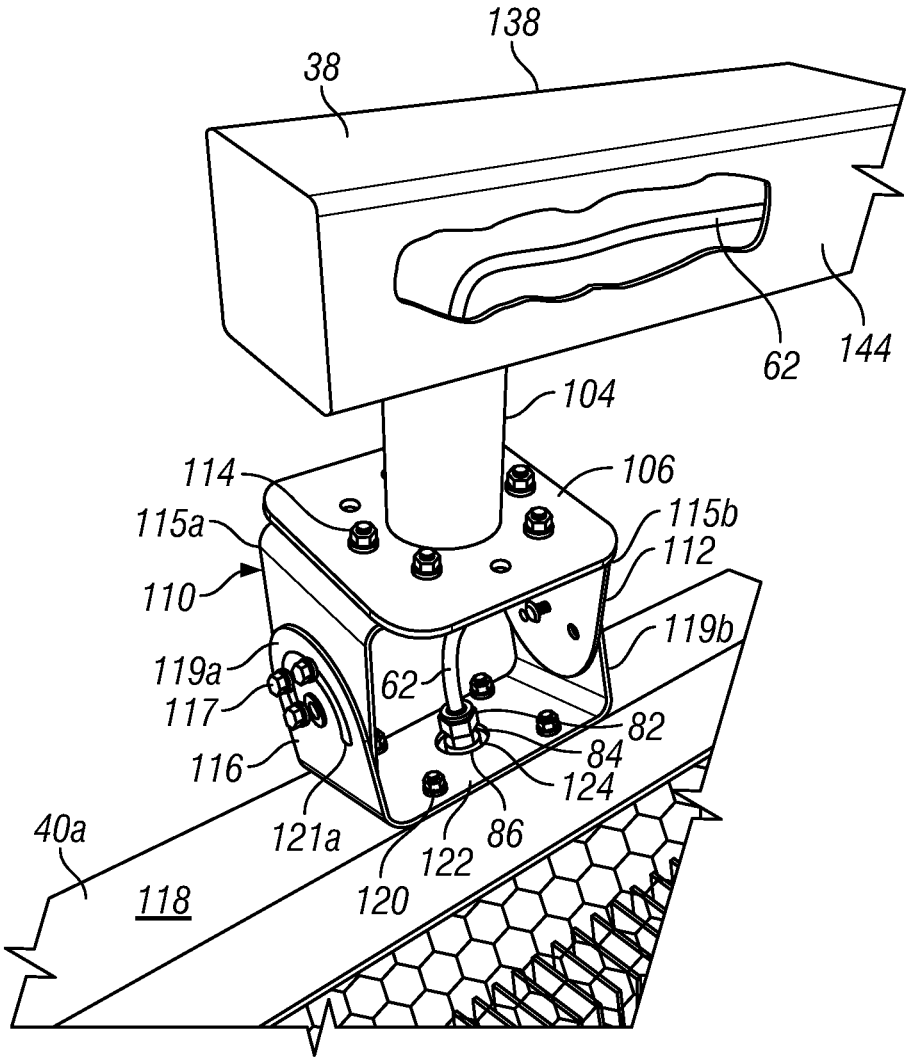
FIG. 9 is a partial perspective view of an exemplary crossarm, in enlarged scale, coupled to a luminaire by a trunnion and a partial cutout showing an internal wiring harness of a crossarm.

Referring now to FIGS. 4, 8, and 9, the crossarm 38 may be connected to the light pole 36 at a preferred height using a coupling such as a clamping element, generally designated 90. The clamping element includes a face plate 92 and a back plate 94 which both include inner surfaces constructed to complement the outer surface 96 of the light pole 36, whether curved, straight, faceted, or other shape. Each plate includes a set of bolt holes (filled with fasteners in FIG. 8) to be aligned and then the plates 92, 94 secured together around the light pole 36 using a set of bolts 98 secured by nuts 100 or other suitable fasteners. The clamping element 90 may be tightened to fix the crossarm 38 in place along a selected height of the light pole within the crossarm mounting section 70 or loosened and repositioned at an alternative location along the light pole and then re-tightened as desired. In addition, the clamping element 90 does not interfere with the addition or subtraction of other crossarms since the clamping element may be secured without removing another crossarm along the height of the light pole assuming there is enough spacing between luminaire sets along the light pole 36. The back plate 94 may be bolted directly to the back surface 144 of the crossarm 38 using another set of complementary fasteners 102*a*, 102*b* such as bolts and nuts. When fastened, the clamping assembly secures the crossarm 38 at a location along particular height of the light pole 36. The crossarm 38 further includes a downwardly extending tubular section or trunnion mounting plate spacer 104 (FIG. 9) that terminates in a trunnion mounting plate 106 extending outwardly beyond the perimeter of the tubular section 104. In this exemplary embodiment, there is one tubular section and trunnion mounting plate for each luminaire 40*a-d*.

Figure 7:
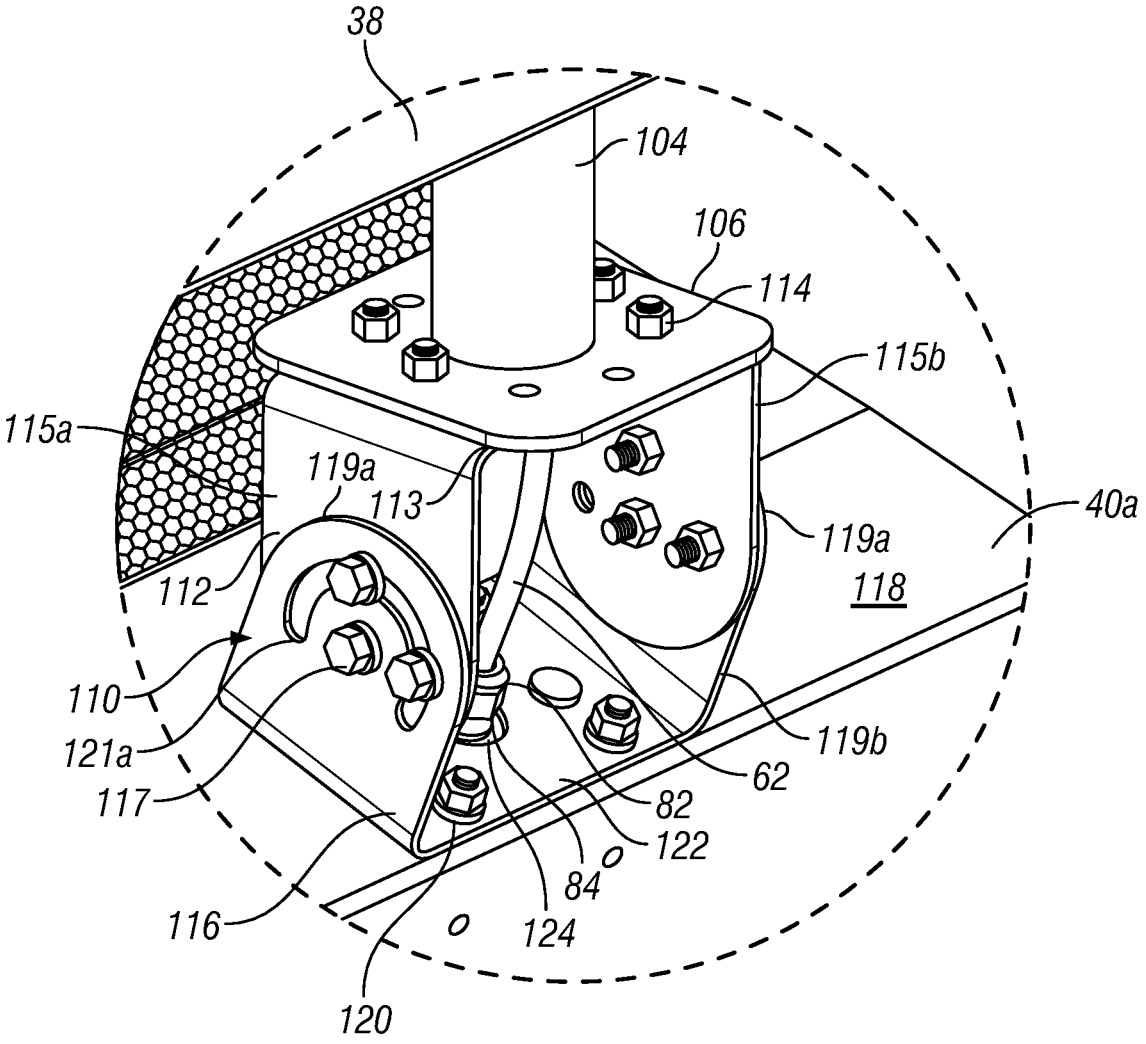
FIG. 7 is a perspective view of an exemplary trunnion assembly, in enlarged scale, that may be used to couple a luminaire to a crossarm as taken from the circle 7 of FIG. 4.
Figure 10:
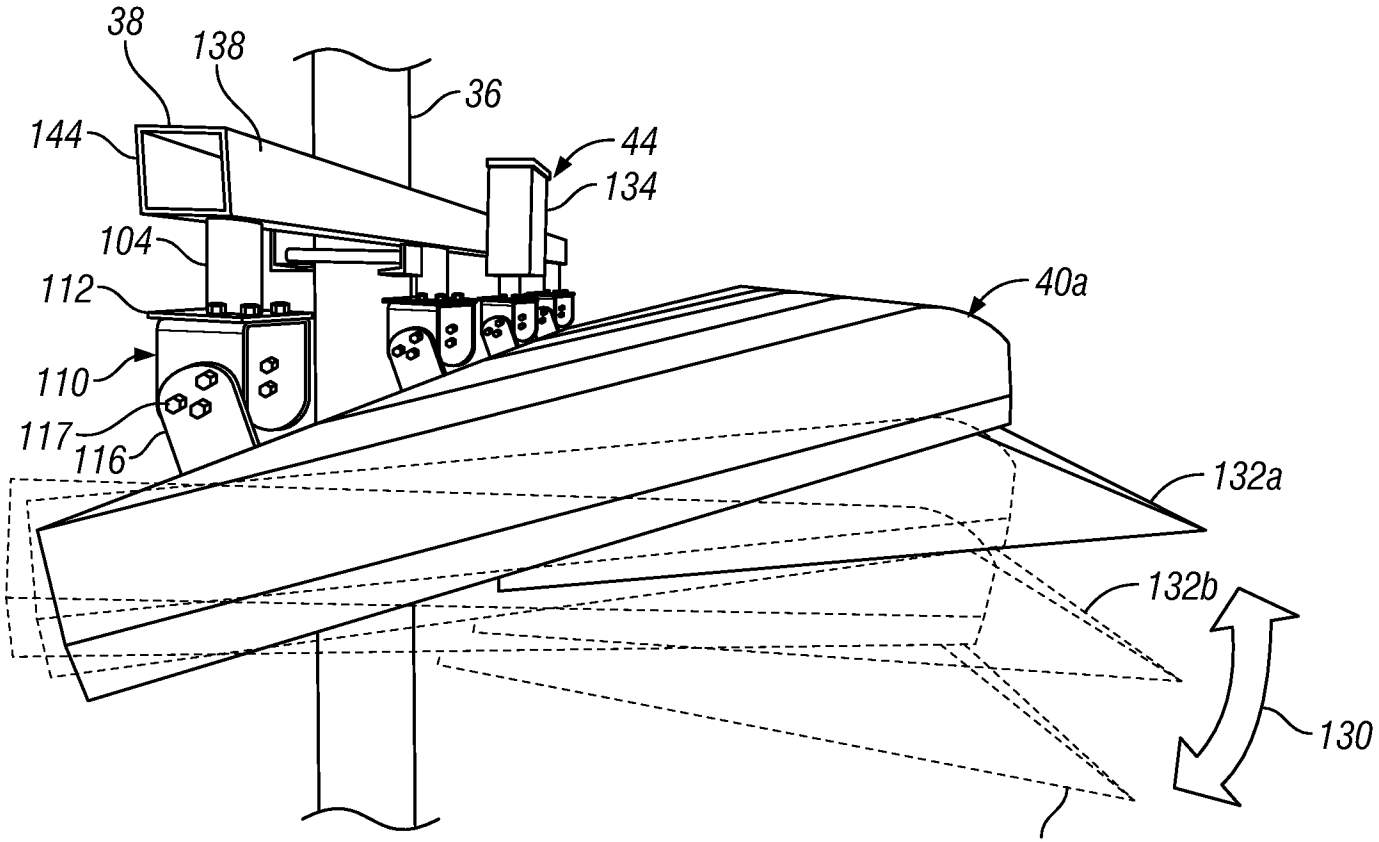
FIG. 10 is a side view of an exemplary lighting luminaire, in enlarged scale, coupled to a crossarm by a trunnion assembly and depicting three alternative representative tilt positions.

Referring now to FIGS. 7 and 9, to secure the one or more luminaires 40*a-d* to the crossarm 38, a trunnion, generally designated 110 is used as best shown in FIGS. 4, 7, and 9. Each trunnion includes a trunnion base bracket 112 with a flat central section 113 secured to the trunnion mounting plate 106 by one or more fasteners 114, such as nuts and bolts. The trunnion base bracket 112 is then pivotally coupled to a trunnion housing bracket 116 by a set of opposing downwardly projecting ears 115*a*, 115*b* inserted between a pair of complementary upwardly turned ears 119*a*, 119*b* of the trunnion housing bracket 116. The respective ears 115*a*, 119*a*, and 115*b*, 119*b* are fastened with a set of suitable fasteners 117 such as nuts and bolts. The trunnion housing bracket 116 further includes a bottom flat central plate 122 which is in turn coupled to the top surface 118 of the corresponding luminaire using another set of suitable fasteners 120. The trunnion housing bracket includes a pair of opposing ears 119*a*, 119*b*, each including a slot 121*a*, 121*b* (not shown in FIG. 9). The angle the housing bracket 116 is attached to the base bracket 112 determines the angle the corresponding luminaire 40*a-d* from the crossbar 38. As shown in FIG. 10, loosening the fasteners 117 allows the user to pivot the luminaire 40 through the direction indicated by the tilt arrow 130 through a plurality of alternative positions 132*a*, 132*b*, 132*c*, limited only by the length of the slots 121*a*, 121*b* (not shown) and obstructions presented by the crossarm 38. The trunnion housing bracket 116 further includes a coupling opening 124 in the central plate 122 through which a quick connect coupling 84 projects allowing for a quick connect assembly to the quick connect 82 of the crossarm wiring harness 62. As explained below, this tilt may be preset based on the photometric analysis of the venue saving the installer considerable installation time at the installation site (venue).

Figure 11:
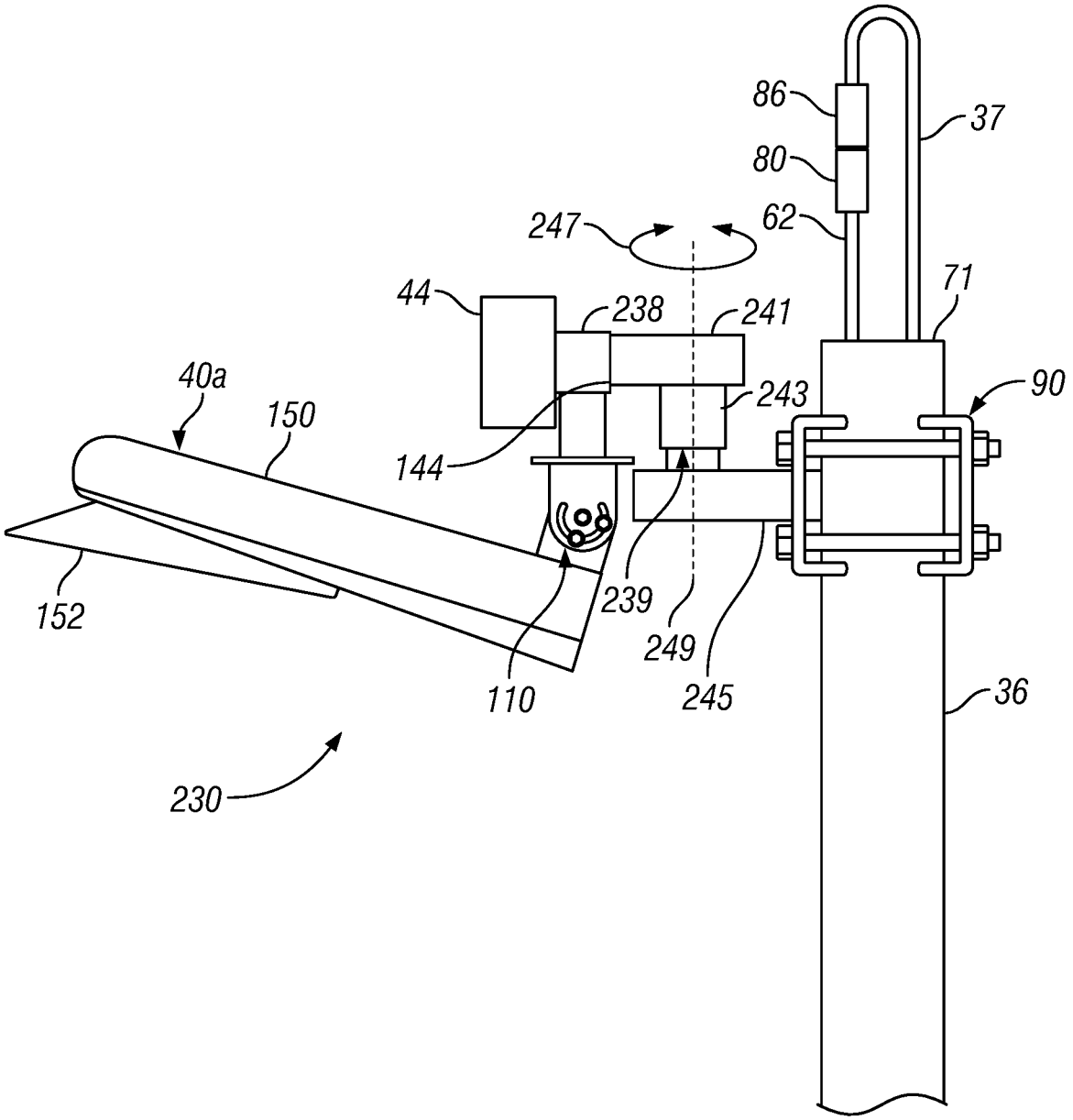
FIG. 11 is an alternative embodiment of an exemplary luminaire, in enlarged scale, that may be rotated about a Z-axis for use with a high mast lighting system.
Figure 16:
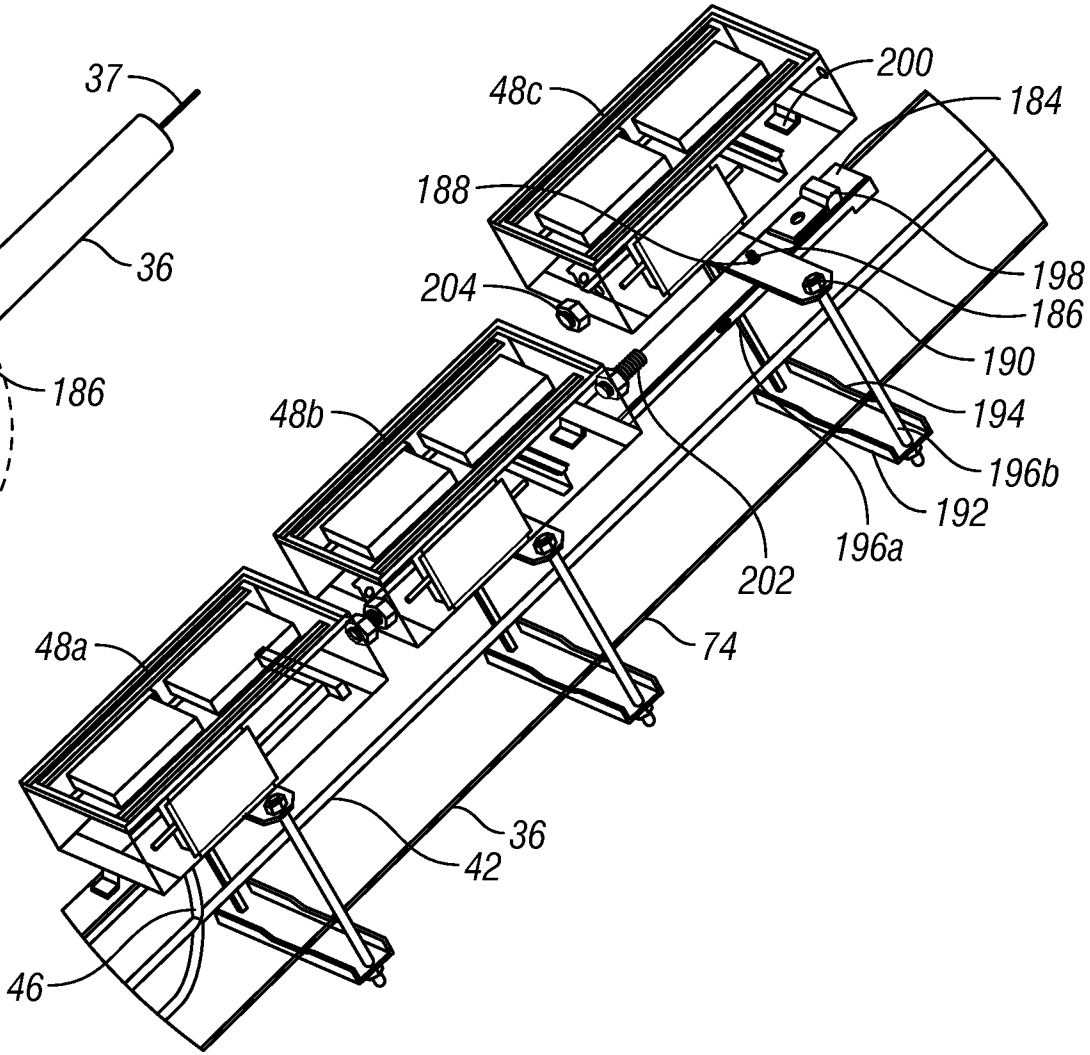
FIG. 16 is a closeup view of a section taken from circle 16 of FIG. 15.
Figure 17:
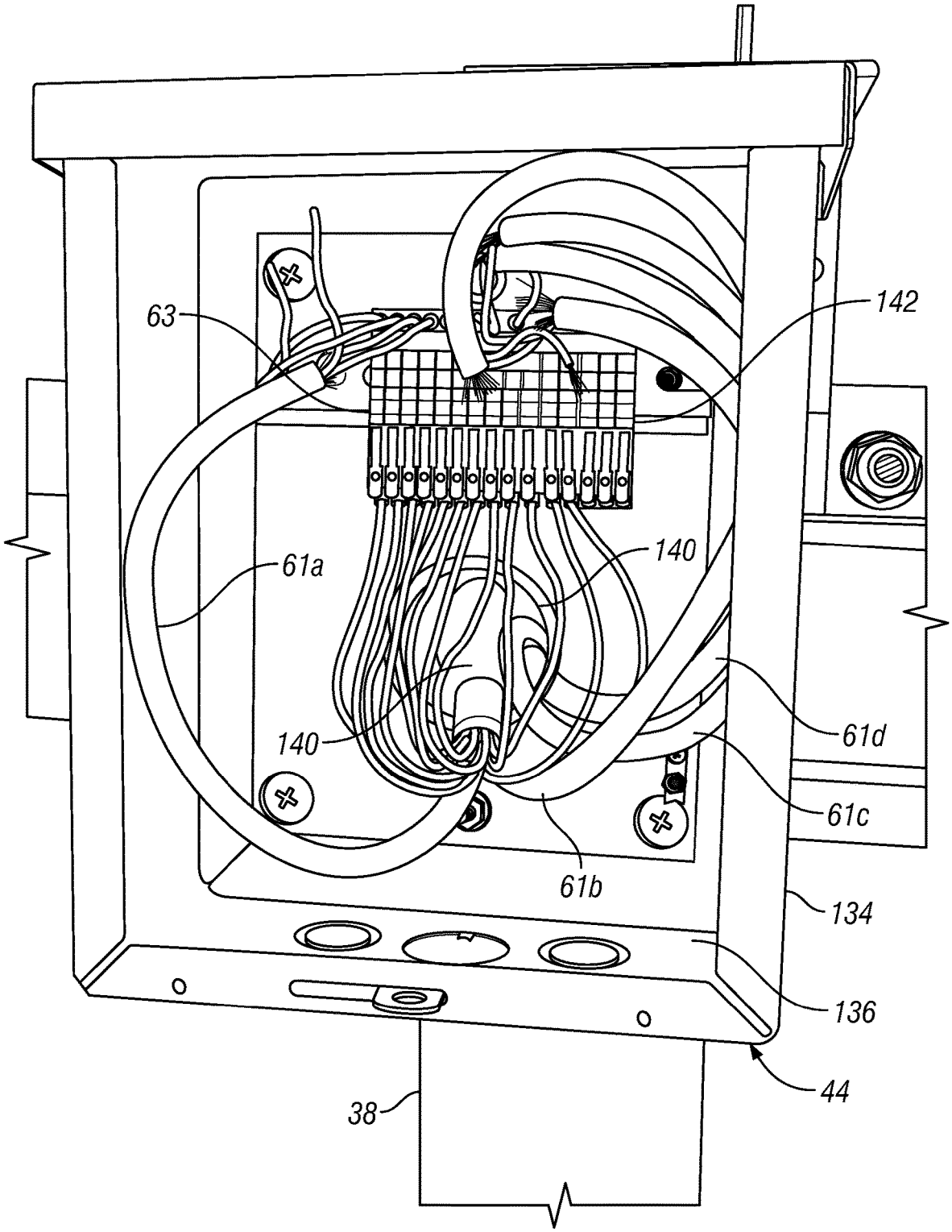
FIG. 17 is an enlarged view of an exemplary junction box of an exemplary crossarm for use with a high mast lighting system.

An exemplary junction box 44 is shown in FIGS. 4 and 10 with an open box shown in FIG. 17. The junction box includes a housing 134 with a hollow interior 136. The junction box is positioned on the front face 138 of the crossarm 38 and may be bolted to the crossarm, welded thereto, or otherwise suitably fastened to the crossarm. The junction box includes a pole cable opening 140 for receipt of interface wiring harnesses 61 and/or the upper end of the pole cable 37. A terminal block 63 may be coupled to the incoming wiring harnesses 61*a-d* (FIG. 17) from the enclosure(s) 48. In addition to or as an alternative, an upper end quick connect 86 of the pole cable 37 may be coupled to a quick connect 80 of the crossarm wiring harness 62 as shown in FIG. 11 wherein a portion of the light pole has been removed to show the connection. Along the way, one or more pigtail wire connections 46 (FIG. 16) from the pole cable 37 may enter each local housing or enclosure 48 (if used) and into a main breaker 50 triggered by the throw or kill switch 182.

Referring to FIGS. 2, 5-7, and 9, the luminaires 40*a-d* are supported from the crossarm as described above. Each luminaire generally includes a housing 150, a glare shield 152, and one or more LED arrays 66. The LED arrays are placed in electrical communication with the LED drivers 60 using the crossarm wiring harness 62 and interface wiring harness 61 as described above. Reflector fins 154 may be incorporated into the luminaire to further enhance the light emitted from the bottom facing opening the luminaire. A number of heat sinks 156 may be spaced about the top side of the panel supporting the LED arrays for managing heat production. A protective lens (not shown) covering the bottom facing opening may be used as well if desired. Suitable luminaires may be found in U.S. Pat. No. 10,168,023 to Hein, which is incorporated by reference in its entirety herein. Other luminaires such as those sold under the VUE or NV brands by NLS Lighting, LLC of Carson, Calif. may be used as well as other suitable luminaires that would occur to those of ordinary skill in the art. Existing luminaires may be modified by adding the trunnion 110 to couple to the crossarm 38.

As shown in FIG. 1, each light pole 36 may include at least one local housing or enclosure 48 conveniently mounted on the pole at an accessible height around six to fifteen feet off the ground and below the mid-point 72 of the pole. As shown, for example, in FIG. 2, the local housing 48 is located proximate the upper edge 160 of the fence 162 surrounding the venue 34. It will be appreciated that the luminaire controls 56*a-d* may be located completely within, within but externally accessible, on the housing, near the housing, or without a housing but on or proximate the pole, and distal from the luminaires while being disposed at easily accessible location for maintenance, exchange, and upgrading. Such housing may be accessible from the ground or using a simple ladder and without requiring a basket lift or crane normally required to service the luminaires at the top of a high mast pole. As the control nodes are most likely to be upgraded as features are added, this accessible location greatly reduces the maintenance and retrofitting time. It will be appreciated that the local housing may be locked or otherwise secured to prevent access to the components contained inside.

Figure 12:
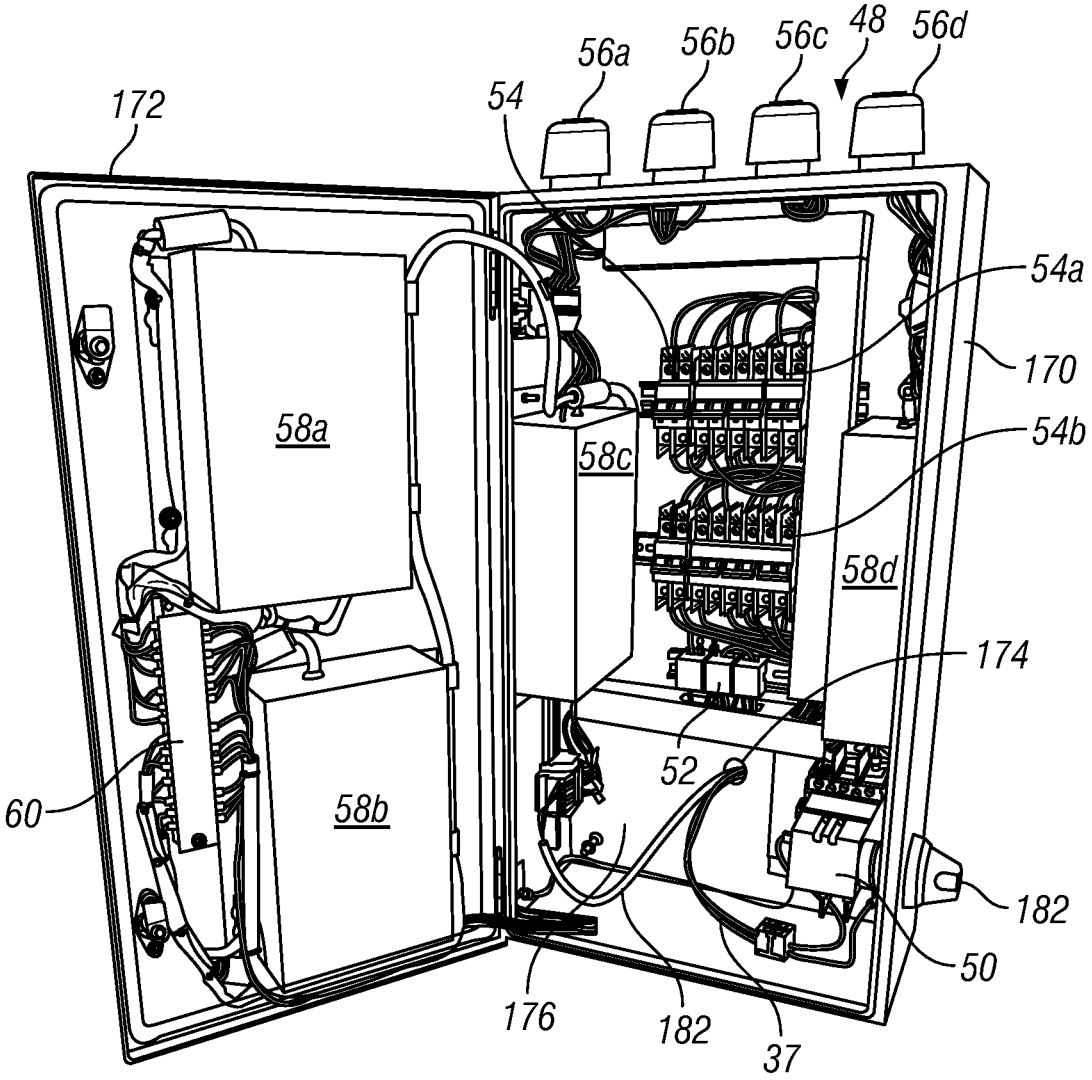
FIG. 12 is a close-up view of an exemplary enclosure or local housing in an open door configuration with a set of exemplary control nodes atop the enclosure.
Figure 13:
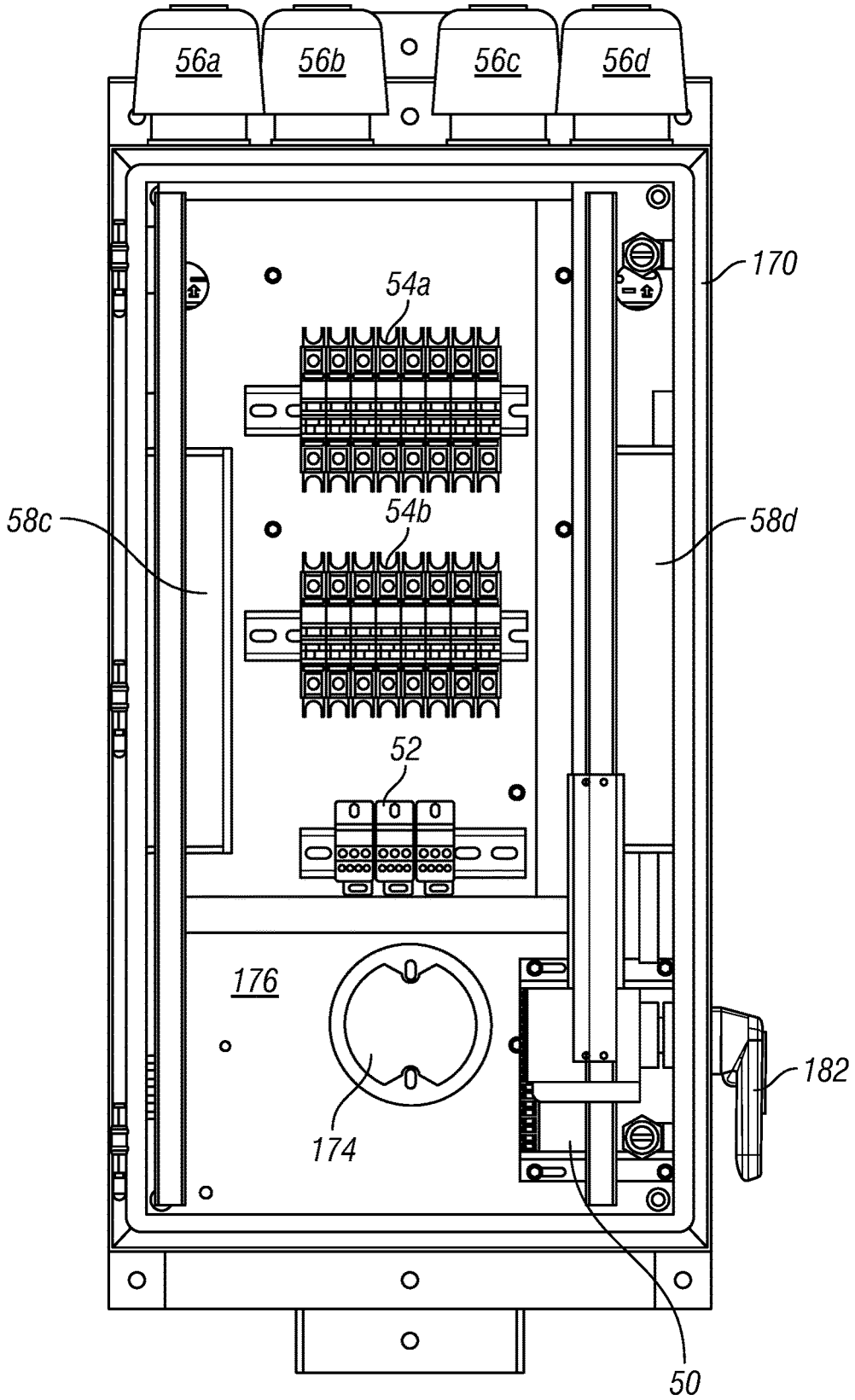
FIG. 13 is a front view of the enclosure of FIG. 12, in enlarged scale, with some components removed for ease of description.

Referring now to FIGS. 12 and 13, a description of an exemplary local housing 48 with a set of components located within or on the enclosure 48 will now be described. The housing includes pole mounting section 170 and a cover 172 hingedly connected to the pole mounting section. Within the hollow interior, a set of LED drivers 58*a*, 58*b*, 58*c*, 58*d* are secured. In his exemplary embodiment, there are four LED drivers, two are secured to large interior face of the cover 172 and two are secured to the inside walls of the mounting section 170. These LED drivers are in electrical communication with their counterparts luminaires 40*a-d* via the wiring harness 61 and 62 running through the light pole 36. In this exemplary embodiment, there is one LED driver per luminaire.

Still referring to FIGS. 12-13, there is an opening 174 in the back surface 176 of the mounting section 170 for receiving the entering portion of the pole cable 37 leading to a main circuit breaker assembly 50 with a throw switch 182 mounted externally on the housing 48. This throw switch acts as a kill switch to turn off all power to the enclosure 48 prior to opening the cover 172 so that maintenance may be performed safely. Another wiring section 182 leads to at least one distribution block 52 which in turn is connected to a set of mini-breakers 54*a-b* (FIG. 12). The mini-breakers are electrically connected to a set of connector or control nodes 56*a-d*. In this embodiment depicted in FIGS. 12-13, the nodes 56*a-d* are mounted atop the mounting section and externally accessible when the cover 172 is closed. The connector nodes are then placed in electrical communication with the LED drivers 58*a-d* which further connect to the interface harness 61 through a terminal block 60. While the control nodes 56*a-d* are depicted atop the housing in FIGS. 12-13, it will be appreciated that alternative locations may be used. For example, in FIG. 3, one alternative is to locate the control nodes 256 atop the housing as shown in FIGS. 12-13. Another alternative is to locate the control nodes 356 partially internal to the housing but externally accessible without having to remove the cover 172. However, another alternative is to locate the control nodes 56 completely within the housing, which may be secured with a locking device, as depicted schematically in FIG. 3. If a housing or enclosure is not used, the control nodes may be mounted on the light pole or nearby and well below the mid-point of the light pole for easy access.

Figure 14:
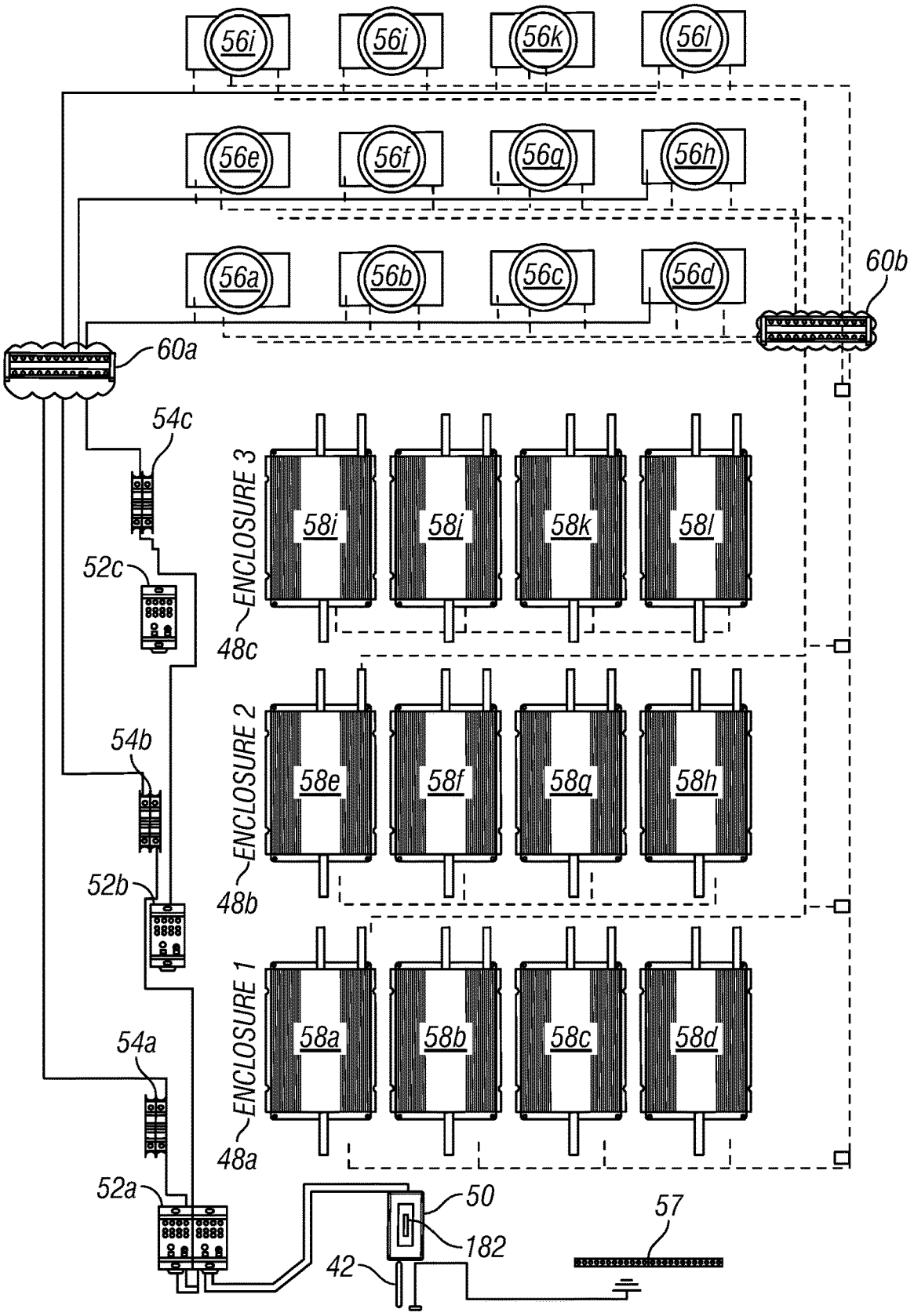
FIG. 14 is a schematic of an exemplary set of enclosure componentry and related electrical paths.
Figure 15:
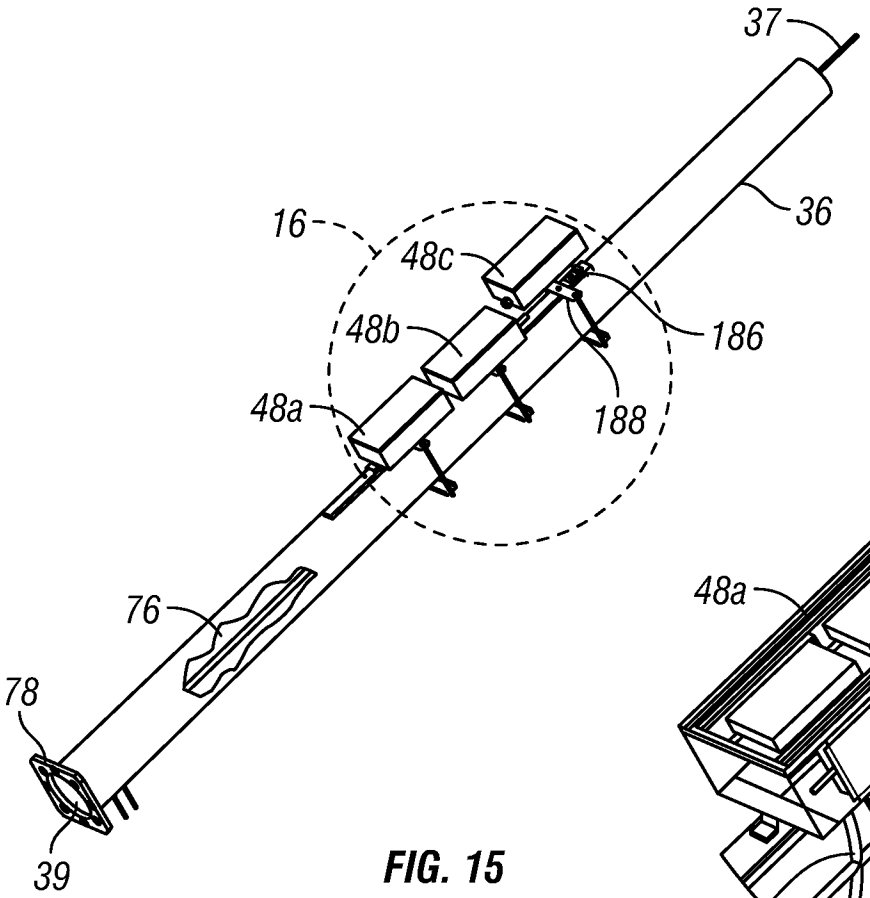
FIG. 15 is another exemplary embodiment of a light pole with three enclosures that may be used with a high mast lighting system.

Turning now to FIGS. 14-16, another exemplary embodiment, this one with three enclosures, generally designated 48*a-c*, will now be described. It will be appreciated that each housing may be associated with a particular crossarm 38 and related luminaire set 40*a-d* but a single housing may be also used to accommodate all LED drivers, control nodes, and associated circuitry and wiring. In addition, a one to one basis between enclosures and crossarms is not required as, for example, a single housing may accommodate two crossarms or two housings may accommodate three crossarms. Generally, the size of the housing versus the number of components installed inside and their relative sizes will dictate the number of housings. For maintenance purposes, a one to one housing to crossarm arrangement helps to keep the circuits organized.

In this exemplary embodiment, each enclosure 48*a-c* is associated with four LED drivers 58*a-d*, 58*e-h*, and 58*i*-1, respectively. Each LED driver is connected to its own control node 56*a*-1, respectively, via a set of terminal blocks 60*a-b* with a set of mini-breakers 54*a-c* interposed between the control nodes and terminal blocks. The pole cable 37 begins the electrical path and is connected to the main breaker 50 which is in turn connected to at least one distribution block 52*a-c*, which are in turn connected to the mini-breakers. These components are housed within a corresponding local enclosure or at the alternative locations discussed above.

Referring to FIG. 16, the local housings 48*a-c* may be mounted to a section of the pole 36, preferably within the lower section 74 and well below the mid-point 72 of the pole. As the enclosure connections are the same, an exemplary connection will be described for a single enclosure 48*c*. An elongated enclosure mounting bracket 184 is secured to the outer surface of the light pole. The mounting bracket includes an alignment boss 186 for receiving a complementary boss aperture 188 in a first cross member 190. A second cross member 192 with a central inner surface 194 contoured to complement the outer surface of the adjacent pole section. Each cross member has a set of aligned holes to receive a set of elongated fasteners 196*a*, 196*b* such as bolts and nuts. A hook alignment element 198 is secured to the mounting bracket 184. A complementary hook 200 located on the back surface of the enclosure mounting section 170. The enclosure 48*c* may then be hung on the mounting bracket 184.

It will be appreciated that a pigtail 46 (FIG. 16) may enter the first enclosure 48*a* encountered. As the enclosures are mounted vertically atop one another, they may be connected in series. To facilitate completing the electrical path between enclosure, a quick connect 202 may be located on the top of each enclosure such as that shown on enclosure 48*b*. A complementary quick connect 204 may be located on to bottom of the adjacent enclosure 48*c*. These quick connectors 202, 204 may be joined to continue the electrical path from the first lowermost enclosure 48*a* through the intermediate enclosure 48*b* and into the uppermost enclosure 48*c*. This feature saves on having to pigtail the pole cable for each enclosure, although this option is available as well as other wiring harness varieties, lengths, and respective connections, preferably those that facilitate improved installation and maintenance times as well as safety.

Turning now to FIGS. 1, 2, and 4, a laser 210 may be conveniently mounted at or near the top end 71 (FIG. 2) of the pole 36 to facilitate aiming of the luminaires 40*a-d*. In other conventional systems, a laser is commonly used in conjunction with a series of grids laid out over the surface to be illuminated requiring both the X and Y axes to be aligned. For the present high mast lighting system 30, however, the process of aligning the crossarm may be performed relying solely on the X-axis or the Y-axis by aiming at a distant target instead of both axes. The laser 210 may be magnetically mounted atop the junction box 44 during installation and then be actuated remotely or by a person in a lift installing the crossarm and directed at a distal target 211 on the field to be illuminated and used to align either the X or Y directions of the crossarm 38 to position the crossarm. This process significantly reduces the amount of time to align the crossarm as it avoids the tedious and time-consuming grid layout and alignment per grid process as with other systems. This laser aiming process may be used in lieu of or as a complement to the pre-aimed crossarm calculations determined by the photometric analysis. The selected laser is also visible in the daytime on the target 211.

Turning now to FIG. 11, in another embodiment of the high mast lighting system, generally designated 230, and wherein like components are like numbered, a pole 36 includes a crossarm 238 constructed similarly to the crossarm 38 described above. However, there is an additional rotational coupling, generally designated 239, with a horizontal support 241 projecting into and coupled to the back 144 (FIGS. 4 and 11) of the crossbar 238. The horizontal support is mounted atop a rotational collar 243 set atop a pole support 245. This allows the entire crossarm to be swiveled about a Z-axis 249 parallel to a longitudinal axis projecting through the light pole 36 in the in direction of arrow 247 to rotate the crossarm 38 relative to the light pole. Like the laser aiming system, this feature may be used in lieu or complementary to the pre-rotation of the crossarm 238 based on the photometric analysis of the venue.

Figure 18:
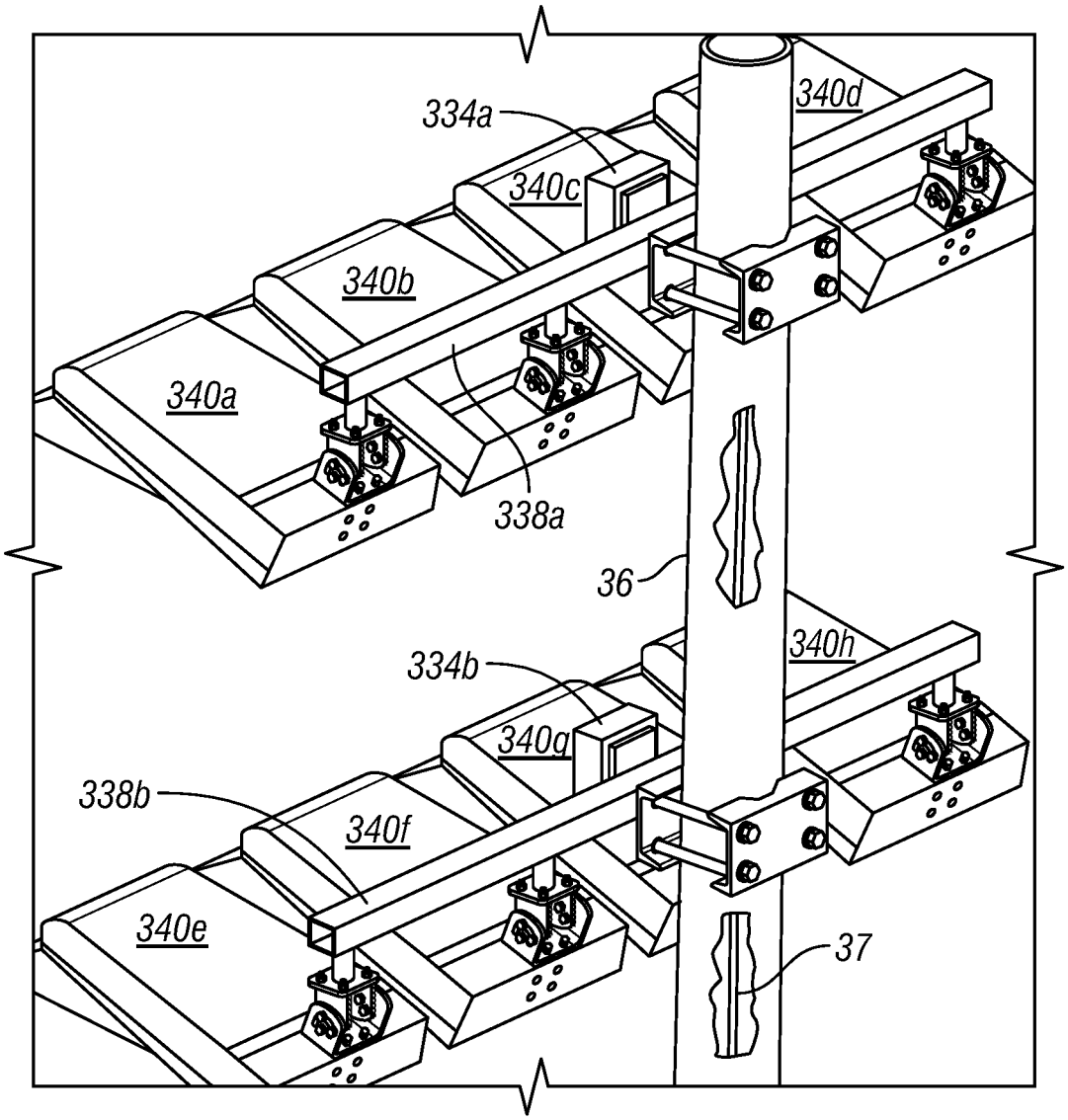
FIG. 18 is another alternative embodiment of a high mast lighting system having a dual crossarm, four luminaire configuration.

Referring now to FIG. 18, another exemplary embodiment of the high mast lighting system is depicted. While the prior embodiments incorporated a single crossarm 38 with four luminaires 40*a-d* as, for example, shown in FIGS. 1, 2, and 4, other configurations may incorporate multiple crossarms 338*a*, 338*b*, each bearing a set of luminaires. In this exemplary embodiment, the upper crossarm 338*a* includes luminaires 340*a-d* while the lower crossarm 238*b* supports luminaires 340*e-h*. Each crossarm 238*a*, 238*b* may be coupled to the light pole 36 as discussed above using the clamping system enabling the crossarms to be located anywhere on the pole in the crossarm mounting section and then adjusted vertically along the height of the pole as required to satisfy the lighting requirements of the venue. Each crossarm 338*a*, 338*b* includes its own respective junction box 334*a*, 334*b*, respectively, supplied with power by the pole cable 36 with each crossarm being independent of the other. As discussed above, a set of control nodes and LED drivers would be associated with each luminaire allowing each luminaire to be monitored and controlled individually or all together. It will be appreciated that other configurations may be used as well. For example, the following configurations would fall within this disclosure: a single crossarm with one to six luminaires, dual crossarms with seven to twelve fixtures and other crossarm/luminaire combinations as well.

An assessment of the lighting requirements of the venue 34 is preferably conducted prior to installation of the high mast lighting system 30. The required lumens, foot candles, distance from surface to be illuminated, directions, tilt and rotation angles, and wind factors may all be analyzed. As a result of the light requirement findings (photometric analysis) and condition of the location 34, the crossarm 38 may be delivered to the field site 34 pre-wired and pre-aimed, including tilt and rotation angles. By pre-wiring and pre-aiming the crossarm and using quick connectors for coupling the pole cable 37, housings 48, crossarms 38, and luminaires 40*a-d*, installation may be expeditiously performed. Once the preferred locations of the crossarms are established, the electrical components may be easily and quickly connected using the terminal blocks or quick connects. The luminaires may also be mounted to the crossarm prior to lifting up onto the light pole or installed after the crossarm is secured. If necessary, fine adjustments may be made using the laser, raising the crossarms up and down along the height of the pole and clamping and re-clamping as needed, rotating the crossarms, and/or tilting the luminaires using the adjustable trunnions to establish the preferred lighting results.

A guide rod may also be used during the installation process to hold the crossarm in place and aligned on the pole until it is secured. The guide rod (not shown) may be slidingly clamped along the crossarm 38 during installation. The clamp may be secured to the crossarm using a clevis pin with handle secured by a cotter pin. Projecting from the clamp is an elongated lifting support arm with an eyebolt for securing to a sling. Slings suspended from a high reach forklift or Jiffy Boom lifting device may be tied around the crossarm at several locations including the eyebolt allowing the entire assembly of crossarm and luminaire set to be lifted together. Once raised to the desired height, the crossarm and luminaire assembly may be leveled and positioned near the pole. Any cable assemblies projecting through the light pole 36 may be routed toward their complementary connectors. The crossarm may then be clamped loosely in place to the light pole. The laser 210 may be magnetically attached to the top of the junction box 44 and used to aim the crossarm/luminaire assembly toward the specified target 211. Once aligned, the clamp 90 is tightened against the pole. Then, the connector 86 (FIG. 11) of the pole cable 37 may be connected to the complementary connector 80 of the crossarm wiring harness 62. The guide rod and laser are then removed leaving the crossarm/luminaire set assembly in place. It will be appreciated that adjustment of the luminaires is unlikely to be needed as they were pre-aimed, pre-rotated, and pre-tilted on the crossarm before lifting based on the photometric analysis.

In addition to the foregoing installation process, the control nodes are generally selected for easy exchange and upgrade capabilities. While this disclosure focuses on lighting controls, especially those for individual fixtures, as more and more features are introduced to take advantage of the high mast lighting system, new and improved control nodes may be easily be accessed and swapped with replacement or upgraded models. For example, other capabilities such as gunshot location, crime fighting features, environmental monitoring, traffic monitoring, sensory monitoring, and other features may be added to the high mast lighting system 30.

While the embodiments described are primarily in conjunction with a venue such as a baseball park, other sports and entertainment venues may benefit from the high mast lighting system 30 as disclosed herein and its equivalents. Examples includes all types of sports fields, parks, concert and other outdoor entertainment venues, as well as ports, freeways, and other areas requiring illumination with significant pole heights range from 40 feet to 200 feet wherein the user or maintenance representatives would benefit from being able to easily access the controls locally at or near the pole and monitor and control individual luminaires from an easily accessible height. Other applications will occur to those of ordinary skill in the art and are deeded within the scope of this application.

Materials: The light pole, crossarm, and luminaires may be constructed of conventional materials commonly used in high mast applications. Suitable control nodes such as an Ethernet Cellular and Wi-Fi Gateway, Model Nos. Cimcon Twist-lock 7 Pin Part Number iSLC3100-7P-480-INV-A-G-1O-CATC-20-T (for inside or outside local housing), Cimcon Twist-lock 7 Pin Part Number iSLC-3100-7P-COC-A-1O-CATB-20 Universal (for inside or outside local housing), or Cimcon Driver Style Part Number iSLC3300 wireless lighting controller Universal (for inside local housing), all available from Cimcom Lighting, along with a Lighting Gale-Gateway E, also available from Cimcom may be used. This control or connector node may communicate with a remote monitoring and control station primarily using satellite technology. Another suitable control node is available from Philips under the brand name CITYTOUCH connector node, Model Nos. LLC7290, LLC7291, LLC7294 for example. The Philips connector (or control) node may communicate with a remote monitoring and control station primarily using cellular technology or a mobile network. Among other features, these control nodes allow the user to individually control the on/off status of each luminaire, dim each luminaire, and flash each luminaire. Preferred control or connector nodes will allow for both remote monitoring and control over wide area networks using wired communications, wireless communications, or a mix of both, and/or local programming or ad hoc control taking place at the local housing using wired (plug in) or wireless communications including radio-based, Wi-fi, mobile, fixed, Bluetooth, and Near Field Communications (NFC) capabilities such as made available through a networking device in a smartphone, laptop, or tablet device. A GPS chip in communication with or built into the connector node may be used to facilitate light pole location as well. The nodes will typically screw or twist into a threaded receptacle or plug into a pin receptacle or other suitable connector in communication with the LED drivers allowing for simple replacement or upgrading capability. If the node has an exposed surface outside the local housing, then a photocell may be used to provide a power source in addition to receiving power from the power source 42 through a connection in the local housing 48. Conventionally, such control nodes have been placed in a socket atop a fixture mounted atop a light pole. Thus, exchange or maintenance requires a lift basket capable of reaching the fixture height. In the present disclosure, however, it will be appreciated that such control nodes 56*a-d* may be completely enclosed within one more local housings 48, or positioned on the local housings, or partially within the local housings with an accessible external surface, or mounted to the light pole 36 near the local housing or merely on the light pole at a convenient location below the midpoint of the light pole if a local housing is not used. Different nodes may be mounted at different locations as well.

Suitable programmable LED drivers such as the 600 W or 1200 W drivers available from Inventronic have been found to be suitable but other suitable LED drivers may be used as well. Quick connects, preferably rated IP67 for waterproofing, may be used along a length of wire or wiring harness to facilitate the modular installation of the high mast lighting system 30. A suitable exemplary laser such as a 2000M Series laser available from Dreamlizer may be used in the high mast lighting system 30. Such laser is preferably visible during the day on the target to allow for daytime alignments as well as nighttime alignments.

Suitable light poles are typically located around existing venues for retrofitting purposes. New light poles of similar construction may be manufactured for new sites. Construction of such light poles are well within the knowledge of one of ordinary skill in the art familiar with constructing high mast and conventional lighting systems.

While the embodiments disclosed herein illustrate a high mast lighting system surrounding a baseball field or ballpark, numerous other applications abound. By way of example, the high mast lighting system would be especially useful around any indoor or outdoor venue where tall light poles and long-distance lighting are required to illuminate the surrounding area. Such venues would include both recreational settings such as sports parks, fields of play, athletic courts, pools, and parks, entertainment venues such as a concert arena or stage, and business and public venues such as ports and freeways, and other wide areas in which events are played out or performed.

It should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment. Accordingly, no feature or group of features is necessary or indispensable to each embodiment.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

"High mast" typically refers to light poles generally ranging from 98 feet (30m) and taller. However, for purposes of this description high mast incorporates more conventional lighting poles as well with the overall height falling into the 40 to 200 foot range, with luminaire mounting heights falling into the same and often in the 50 to 80 to 120 foot range or higher. This is not meant to be limiting however as generally any lighting system wherein the luminaires are typically out of reach without a lift basket would benefit from the embodiments disclosed herein and their equivalents.

Moreover, conditional language used herein, such as, among others, "can," "could," "might," "may," "e.g.," "for example," "such as" and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The foregoing description and claims may refer to elements or features as being "connected" or "coupled" together. As used herein, unless expressly stated otherwise, "connected" means that one element/feature is directly or indirectly connected to another element/feature, and not necessarily mechanically. Likewise, unless expressly stated otherwise, "coupled" means that one element/feature is directly or indirectly coupled to another element/feature, and not necessarily mechanically. Thus, although the various schematics shown in the Figures depict example arrangements of elements and components, additional intervening elements, devices, features, or components may be present in an actual embodiment (assuming that the functionality of the depicted circuits is not adversely affected).

The methods disclosed herein comprise one or more operations or actions for achieving the described method. The method operations and/or actions may be interchanged with one another without departing from the scope of the disclosure as suitable. In other words, unless a specific order of steps or actions is specified, the order and/or use of specific operations and/or actions may be modified without departing from the scope of the disclosure.

It is to be understood that the implementations are not limited to the precise configuration and components illustrated above. Various modifications, changes and variations may be made in the arrangement, operation and details of the methods and apparatus described above without departing from the scope of the implementations.

What is claimed is:

1. A high mast lighting system comprising:

at least one elongated upright light pole having a crossarm mounting section positioned above a mid-point of the light pole;

at least one crossarm coupled to the light pole within the crossarm mounting section;

at least one luminaire coupled to the crossarm, the luminaire having at least one LED array responsive to a power supply to emanate light from the luminaire;

at least one local control node disposed on or in close proximity to the light pole below the mid-point of the light pole and distally from the luminaire; and at least one programmable LED driver responsive to monitoring and control communications from the local control node including power on and off communications to control the LED array.

2. The high mast lighting system of claim 1 further comprising:

a housing mounted on the light pole below the mid-point and at a distal location from the crossarm, the housing enclosing the at least one programmable LED driver and structurally supporting the at least one local control node; and a power supply line with at least a portion of the line entering the housing and supplying power to the at least one programmable LED driver and at least one control node.

3. The high mast lighting system of claim 1 wherein:

the crossarm is pre-aimed in both a tilt direction and a rotation direction prior to mounting on the light pole based on a venue photometric analysis.

4. The high mast lighting system of claim 1 wherein:

the at least one local control node is a network device in communication with a network and may send, receive, and forward information about the LED array associated with the at least one programmable LED driver.

5. The high mast lighting system of claim 1 wherein:

the at least one local control node programs the at least one programmable LED driver to turn on, off, dim, or flash the LED array associated with the at least one programmable LED driver.

6. A high mast lighting system further comprising:

at least one elongated upright light pole having a crossarm mounting section disposed above a mid-point of the light pole;

at least one crossarm coupled to the light pole within the crossarm mounting section;

at least one luminaire coupled to the crossarm, the luminaire having at least one LED array responsive to a power supply to emanate light from the luminaire;

at least one local control node disposed below the mid-point of the light pole;

at least one programmable LED driver responsive to monitoring and control communications from the local control node;

a housing mounted on the light pole below the mid-point and at a distal location from the crossarm, the housing enclosing the at least one programmable LED driver and supporting the at least one local control node;

a power supply line with at least a portion entering the housing and supplying power to the at least one programmable LED driver and the at least one control node;

a dedicated local circuit breaker disposed in an electrical path between the power supply line and the at least one programmable LED driver;

a first wiring harness with a quick connect coupling mating the at least one programmable LED driver with the crossarm; and a second wiring harness with a quick connect coupling mating the crossarm with the at least one luminaire.

7. The high mast lighting system of claim 2 wherein:

the housing is located below a mid-point of the light pole and distally from the at least one luminaire.

8. The high mast lighting system of claim 1 wherein:

the at least one local control node is operable to control a dimming function of the at least one programmable LED driver.

9. The high mast lighting system of claim 1 wherein:

the at least one local control node is operable to control the on and off status of the at least one programmable LED driver.

10. The high mast lighting system of claim 1 wherein:

the at least one local control node is operable to control a flashing function of the at least one programmable LED driver.

11. The high mast lighting system of claim 1 wherein:

the at least one local control node is operable to control a timing function of the at least one programmable LED driver.

12. The high mast lighting system of claim 1 wherein:

the at least one local control node is operable to power on a plurality of programmable LED drivers when supplied with a remote command.

13. The high mast lighting system of claim 1 wherein:

the at least one local control node is operable to monitor the power status of the at least one programmable LED driver.

14. The high mast lighting system of claim 1 wherein:

the at least one local control node is operable to monitor the wattage of the at least one programmable LED driver.

15. The high mast lighting system of claim 1 wherein:

at least a portion of the at least one local control node is removably inserted into a receptacle and exchangeable with an alternative local control node.

16. The high mast lighting system of claim 1 wherein:

the at least one local control node may be reprogrammed remotely via a wireless communication.

17. The high mast lighting system of claim 1 further comprising:

a laser aiming system coupled to the crossarm and constructed to aim at a single X or Y axis target to align the crossarm.

18. A high mast lighting system comprising:

at least one elongated upright light pole having a crossarm mounting section disposed above a mid-point of the light pole;

at least one crossarm coupled to the light pole within the crossarm mounting section;

at least one luminaire coupled to the crossarm, the luminaire having at least one LED array responsive to a power supply to emanate light from the luminaire;

at least one local control node disposed below the mid-point of the light pole;

at least one programmable LED driver responsive to monitoring and control communications from the local control node; and the at least one crossarm includes a junction box with one or more terminal blocks quick connecting a power cable projecting through the light pole and a luminaire cable in communication with the at least one LED array with no exposed wire between the cross arm and junction box.

19. The high mast lighting system of claim 1 wherein:

the crossarm is slidingly coupled to the light pole and may be adjusted along a height of the light pole within the crossarm mounting section.

20. The high mast lighting system of claim 1 wherein:

the at least one local control node defines a set of LED array characteristics and may vary the LED array characteristics.

21. The high mast lighting system of claim 1 wherein:

the light pole includes a lower end section, an upper end section, and an intermediate section defining a mid-point along the height of the light pole, the upper end and intermediate sections further defining the crossarm mounting section.

22. The high mast lighting system of claim 2 wherein:

the at least one local control node is disposed completely within the housing and distally from the crossarm.

23. The high mast lighting system of claim 2 wherein:

the at least one local control node is disposed at least partially outside the housing.

24. The high mast lighting system of claim 2 wherein:

the at least one local control node is disposed outside the housing and in communication with the at least one programmable LED driver inside the housing.

25. The high mast lighting system of claim 2 wherein:

the at least one LED driver is disposed within the housing and distally from an associated luminaire containing the LED array controlled by the at least one programmable LED driver.

26. The high mast lighting system of claim 1 wherein:

the at least one local control node is operable to allow control of an individual associated luminaire directly at the light pole independent of any third-party control system.

27. The high mast lighting system of claim 1 wherein:

the crossarm may be rotated about a Z-axis relative to the light pole.

28. The high mast lighting system of claim 1 wherein:

at least one programmable LED driver and at least one local control node are associated with each luminaire mounted on a crossarm.

29. The high mast lighting system of claim 1 wherein:

each light pole includes multiple crossarms with multiple luminaires, each luminaire being individually controlled at a local control node.

30. A high mast lighting system comprising:

at least one elongated upright light pole having a lower end section, an upper end section, and an intermediate section defining a mid-point along the height of the light pole, the upper end section defining a crossarm mounting section;

at least one height adjustable crossarm slidably coupled to the light pole within the upper end section, the aim of the crossarm being defined by a rotation angle and a tilt angle, with the aim and location of the crossarm at a selected height on the light pole being determined by a photometric analysis conducted prior to mounting the crossarm on the light pole;

at least one luminaire pivotally coupled to the crossarm and having at least one degree of freedom, the luminaire having at least one LED array selected to illuminate at least a portion of a nearby venue when supplied with power;

a housing mounted on the light pole below the mid-point and distally disposed away from the luminaire;

at least one programmable LED driver disposed within the housing and in communication with the at least one luminaire and constructed to condition the power entering the LED array; and at least one local control node in communication with the at least one programmable LED driver and constructed to issue a set of driver commands locally at the light pole including an on command, an off command, a dimming command, and a flashing command to vary the LED array characteristics at the venue, the control node being removably secured to the housing and being replaceable with an alternative control node.

* * * * *